US005865187A

United States Patent [19]

Fischer et al.

[11] Patent Number: 5,865,187

[45] **Date of Patent: *Feb. 2, 1999**

[54] METHOD AND APPARATUS FOR EXPANDING TOBACCO

[75] Inventors: E. Barry Fischer, Chester; Warren D. Winterson, Midlothian, both of Va.

[73] Assignee: Philip Morris Incorporated, New York, N.Y.

[ * ] Notice: The portion of the term of this patent subsequent to Aug. 24, 2014, has been disclaimed.

[21] Appl. No.: 793,353

[22] PCT Filed: Feb. 24, 1997

[86] PCT No.: PCT/US95/10801

§ 371 Date: Apr. 23, 1997

§ 102(e) Date: Apr. 23, 1997

[87] PCT Pub. No.: WO96/05742

PCT Pub. Date: Feb. 29, 1996

Related U.S. Application Data

[63] Continuation-in-part of Ser. No. 295,111, Aug. 24, 1994, Pat. No. 5,582,193.

[51] Int. Cl.[6] ..... A24B 3/18

[52] U.S. Cl. ..... 131/296; 131/291

[58] Field of Search ..... 131/291, 296, 131/290, 293

[56] References Cited

U.S. PATENT DOCUMENTS

| | | | |
|---|---|---|---|
| Re. 32,095 | 3/1986 | Wu et al. | 131/296 |
| 3,771,533 | 11/1973 | Anderson | 131/296 |
| 3,786,573 | 1/1974 | Scheppe et al. | 131/296 |
| 3,964,873 | 6/1976 | Aramaki et al. . | |
| 4,235,250 | 11/1980 | Utsch | 131/296 |
| 4,258,728 | 3/1981 | de la Burde et al. | 131/296 |
| 4,336,814 | 6/1982 | Sykes et al. | 131/296 |
| 4,388,932 | 6/1983 | Merritt et al. | 131/296 |
| 4,428,453 | 1/1984 | Yuen et al. . | |
| 4,478,862 | 10/1984 | Greenhead | 131/296 |
| 4,494,556 | 1/1985 | Wu et al. | 131/296 |
| 4,528,995 | 7/1985 | Korte et al. | 131/296 |
| 4,559,719 | 12/1985 | Dodson | 131/296 |
| 4,677,994 | 7/1987 | Denier et al. | 131/296 |
| 4,693,264 | 9/1987 | Hedge . | |
| 4,844,101 | 7/1989 | Hirsch et al. | 131/296 |
| 4,938,235 | 7/1990 | Hirsch et al. | 131/296 |
| 5,379,780 | 1/1995 | Uetmatsu et al. . | |
| 5,582,193 | 12/1996 | Fischer et al. | 131/296 |

FOREIGN PATENT DOCUMENTS 2 075 164 11/1981 United Kingdom .

*Primary Examiner*—John G. Weiss
*Assistant Examiner*—Charles W. Anderson
*Attorney, Agent, or Firm*—Burns, Doane, Swecker & Mathis, L.L.P.

[57] ABSTRACT

A tobacco expansion apparatus and method comprising a source of tower gas, an obloid transport duct (20), in communication with the gas source, a tobacco feeder (18) at a location along the obloid transport duct (20) and a separator (22) for recovering tobacco from the expansion apparatus. The tobacco feeder (18) is adapted to introduce tobacco uniformly across the width of the obloid transport duct (20). The apparatus improves the filling power of the processed tobacco and can be operated at higher production rates with less tobacco breakage, thereby improving tobacco yield.

14 Claims, 9 Drawing Sheets

Fig. 9 : Comparative Effect on Filling Power

Let C = circumference
R = radius
D = diameter
A = area

S = length of arc subtended by $\theta$
l = chord subtended by arc S
h = rise
$\theta$ = central angle, radians $\pi = 3.14159...$ $$A\,(\text{segment}) = A\,(\text{sector}) - A\,(\text{triangle}) = \tfrac{1}{2}R^2\,(\theta - \sin\theta)$$

$$= R^2 \cos^{-1}\frac{R-h}{R} - (R-h)\sqrt{2Rh - h^2}$$

METHOD AND APPARATUS FOR EXPANDING TOBACCO

This application is a continuation-in-part of U.S. application Ser. No. 08/295,111, filed Aug. 24, 1994, now U.S. Pat. No. 5,582,193, issued Dec. 10, 1996.

FIELD OF INVENTION

The present invention relates to the expansion of tobacco, and more particularly to methods and apparatus for heating tobacco that has been impregnated with an expansion agent.

BACKGROUND OF THE INVENTION

Expansion is a known way to improve the filling power per unit weight of tobacco (usually measured in units of volume per gram of tobacco). One of the more practiced methods of expanding tobacco includes the steps of impregnating a charge of cut filler tobacco with an expansion agent (or "impregnant") and then rapidly heating the impregnated tobacco to volatilize the expansion agent, thereby causing an expansion of the tobacco tissue. The heating can be effected conveniently by entraining the tobacco in a stream of hot gas (or "tower gas") and directing the stream through a pneumatic conveying column ("tower"). In many expansion systems, a cyclonic separator located downstream of the tower separates the tobacco from the tower gas.

U.S. Pat. No. 3,771,533 discloses a process in which tobacco filler is impregnated with ammonia and carbon dioxide. The impregnated tobacco material is subjected to rapid heating, for example with a stream of hot air or air mixed with superheated steam, whereby the tobacco is puffed as the impregnant is converted to a gas.

U.S. Pat. No. 4,336,814 (PM 745) discloses methods for impregnating tobacco with liquid carbon dioxide, converting a portion of the impregnant to solid form and then rapidly heating the impregnated tobacco to volatilize the carbon dioxide and puff the tobacco.

U.S. Pat. Nos. 4,235,250 and 4,258,729 each disclose impregnation of tobacco with gaseous carbon dioxide under pressure and then subjecting the tobacco to rapid heating after a release of pressure.

U.S. Pat. No. 4,366,825 discloses a method of expanding tobacco in a flow of heated tower gas, with separation of the expanded tobacco from the gas stream being achieved in a tangential separator. The patent discloses a typical prior construction of a tower, wherein the pneumatic conveying column includes a vertically directed, cylindrical pipe.

U.S. Pat. No. 4,697,604 discloses another pneumatic conveying column comprising an upwardly inclined duct of rectangular cross-section. Inclined ducts of the type disclosed in this patent are generally disfavored, because their incline occupies extra floor space at manufacturing facilities, and because the inclined ducts allow gravity to urge tobacco particles toward the lowermost wall of the duct. The rectangular shape also presents corners, where localized eddies tend to entrap tobacco and toast (overheat) same. The corner regions exacerbate the risk of sparking (ignition) of the tobacco within the tower.

The more traditional, cylindrical, pneumatic columns are not without their own problems. Most troublesome has been the tendency of entrained tobacco to travel along one side of a conventional tower, instead of dispersing more uniformly amongst the tower gas. This flow phenomenon is inimical to achieving full and efficient expansion of the tobacco and is referred to in the art as "roping". The limited region along the tower where the tobacco is concentrated or roped is also referred to as a dense phase region. When roping occurs, a substantial portion of the pneumatic column remains as a gaseous region containing very little tobacco, and the concentrated tobacco directly interacts with only a limited portion of the gas stream passing through the tower, so that the heating of the bulk of the tobacco stream is not as rapid or effective as might be expected. A more complete expansion is achieved when tobacco is uniformly heated as rapidly as possible, beginning immediately at the lower portions of the column.

The problem of tobacco concentrating along the wall of a conventional tower seems to become more and more problematic as tower systems are made ever larger and/or as gas velocities in the conventional towers are reduced. A strong preference otherwise exists for the lower gas velocities, because they minimize pneumatic breakage of tobacco strands.

Production scale expansion towers can suffer a roping effect along their entire lengths, unless some corrective action is undertaken. We now believe that roping becomes especially problematic with the larger towers because of a perceived relationship between the diameter of a cylindrical tower and the endurance of a dense phase flow regime. The pipe diameter seems to be proportional with the length of pipe necessary for the dense phase flow to dissipate and for the mixing of tower gas and tobacco to reoccur. A cylindrical tower of a large diameter may therefore suffer roping along a greater portion of its length than a slimmer tower.

In the past, operators of large conventional expansion towers have attempted to limit roping by resorting to elevated gas velocities, which approach exacerbates breakage of tobacco and reduces dwell time of the tobacco within a given tower. The inclusion of baffling within expansion towers (known as "ski jumps") has also been attempted as a way to disrupt roping. However, such baffling also may exacerbate breakage and its effectiveness in disrupting roped flow has proven limited. A better solution has been sought and is herein disclosed, which does not exacerbate breakage and provides other advantages as will become apparent in the description which follows.

BRIEF SUMMARY OF THE INVENTION

Accordingly, it is an object of the present invention to provide a tower unit and method of processing tobacco which minimizes or wholly avoids the occurrence of roping within the tower so as to improve expansion and facilitate operation at lower gas velocities with less tobacco breakage and higher cylinder volumes (CV's) at production level throughputs.

Still another object of the present invention is to provide an expansion tower unit wherein the tobacco is more completely dispersed within a gas flow throughout a greater portion of the tower column such that a more rapid and thorough heating of the tobacco is effected, particularly at the lower portion of the tower column.

It is another object of the present invention to avoid entrapment of tobacco in corners and the like as it passes through a tower unit.

It is still another object of the present invention to provide an expansion tower and method of processing tobacco wherein the cylinder volume (CV) of expanded tobacco upon exiting a commercial sized tower unit is improved.

Yet another object of the present invention is to provide an expansion tower and method of processing tobacco wherein high cylinder volumes (CV's) are consistently achieved over a broader range of throughput rates of tobacco.

Still another object of the present invention is to provide an expansion tower and method which can operate at a lower gas-to-tobacco mass flow ratio without suffering cognizable loss in tobacco cylinder volume (CV).

BRIEF DESCRIPTION OF THE DRAWING

A further understanding of the nature and objects of the present invention will be had from the following description taken in conjunction with the accompanying drawing, in which.

DETAILED DESCRIPTION OF THE PREFERRED EMBODIMENTS

Figure 1:
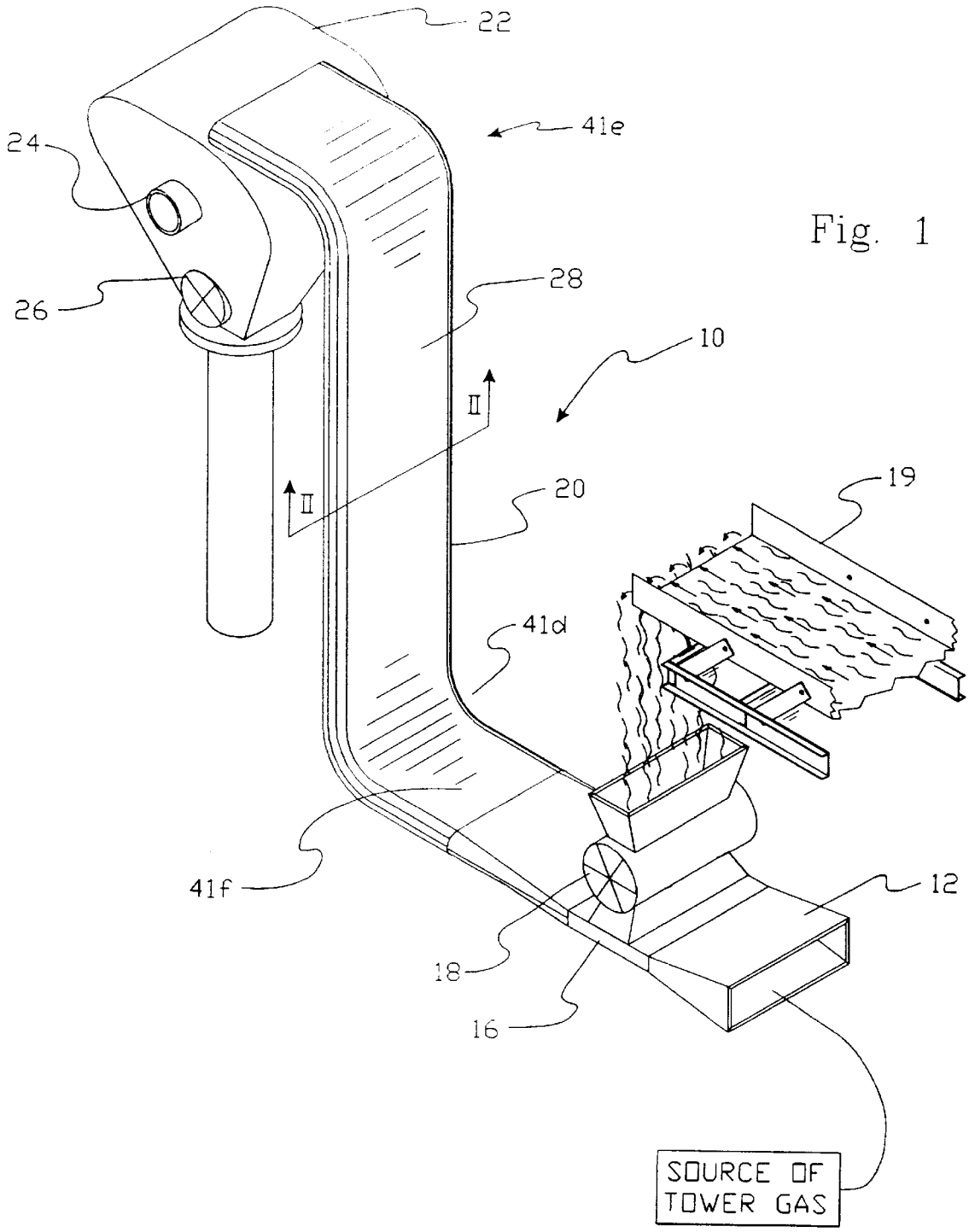
FIG. 1 is a perspective view of a tower unit constructed in accordance with a preferred embodiment of the present invention.

The present invention discloses a method and apparatus for the rapid heating of impregnated tobacco to thereby expand same.

The term "cylinder volume" (CV) is a measure of the relative filling power of tobacco for making smoking products. As used throughout this application, the values employed in connection with CV is determined as follows:

tobacco filler weighing 10.000 gram is placed in a 3.358 centimeter diameter cylinder and compressed by a 1875 gram piston 3.335 centimeter in diameter for five minutes. The resulting volume of filler is recorded as its cylinder volume. This test is conventionally performed at standard environmental conditions of 75° F. and 60% relative humidity, and the sample is preconditioned in that environment for 48 hours.

The term "obloid" as used throughout this specification herein includes generally those shapes shown in the drawing and further including such other forms considered to fall within the general understandings of any of the following terms: "oblong" (deviating from a circular form through elongation); "oblate" (flattened or depressed at the poles); "ellipsoidal" (the cross-section of a surface, all plane sections of which are ellipses); "oval" (a rectangular form having rounded corners or rounded ends) or "elliptical" (relating to or shaped like an ellipse).

Figure 4B:
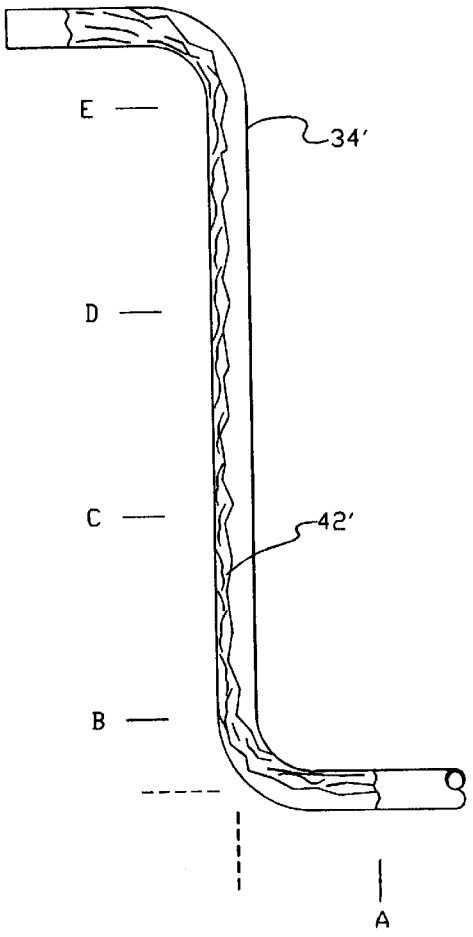
Fig. 4b (PRIOR ART)
FIGS. 4*a* and 4*b* are sectional views of cylindrical transport ducts of the prior art, showing an 8 inch diameter and a 24 inch diameter duct, respectively, including a representation of how tobacco particles and strands flow therethrough.
Figure 4A:
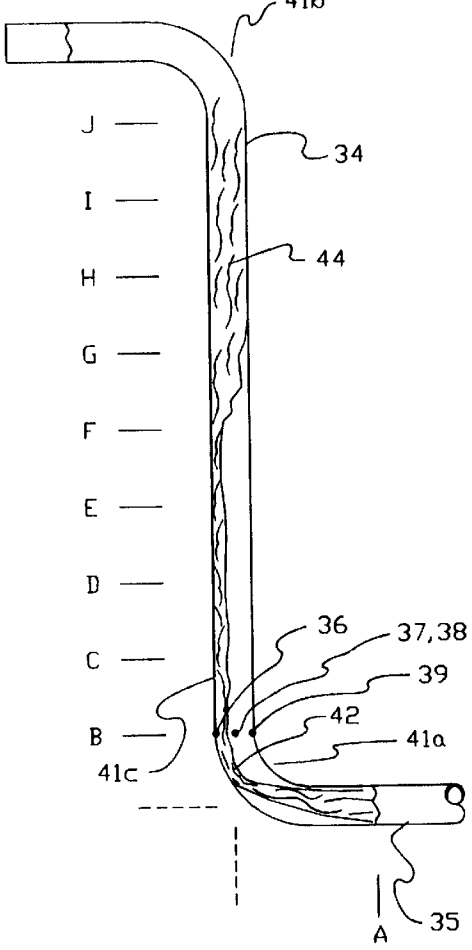
Fig. 4a (PRIOR ART)

Referring to FIGS. 4*a* and 4*b* and to U.S. Pat. No. 4,366,825, the prior art included tower units having cylindrical transport ducts 34. The cylindrical ducts 34 and 341 shown in FIGS. 4*a* and 4*b* are 8-inch diameter and 24-inch diameter, respectively.

Referring now particularly to FIG. 4*a*, analysis was undertaken to attempt an understanding of what flow conditions arise at various locations A through K within the cylindrical transport duct 34 of 8 inch diameter. Each lettered station was corresponded with a cross-sectional plane across the duct 34.

Although the locations A–K may vary from figure to figure amongst the drawings, in the 8-inch transport duct 34 of FIG. 4*a*, the location A was located along a horizontal portion of the duct 34 prior to the lower bend 41*a* in the duct 34. Locations B–J were equally spaced and began above the terminus of the lower bend 41*a*, with the last location J lying just below the beginning of the upper bend 41*b* in the duct 34 and location K was situated beyond the upper bend 41*b*. Analysis included placement of sets of four thermocouples 36, 37, 38 and 39, at each location A–K. At most locations, such as at location B, the thermocouples 36–39 were equally spaced about the cylindrical duct 34 such that the position of thermocouple 36 is on the side 41*c* of the duct 34 distal from the inlet 35. This arrangement of thermocouples in FIG. 4*a* is repeated in similar fashion at all the other locations.

Figure 3:
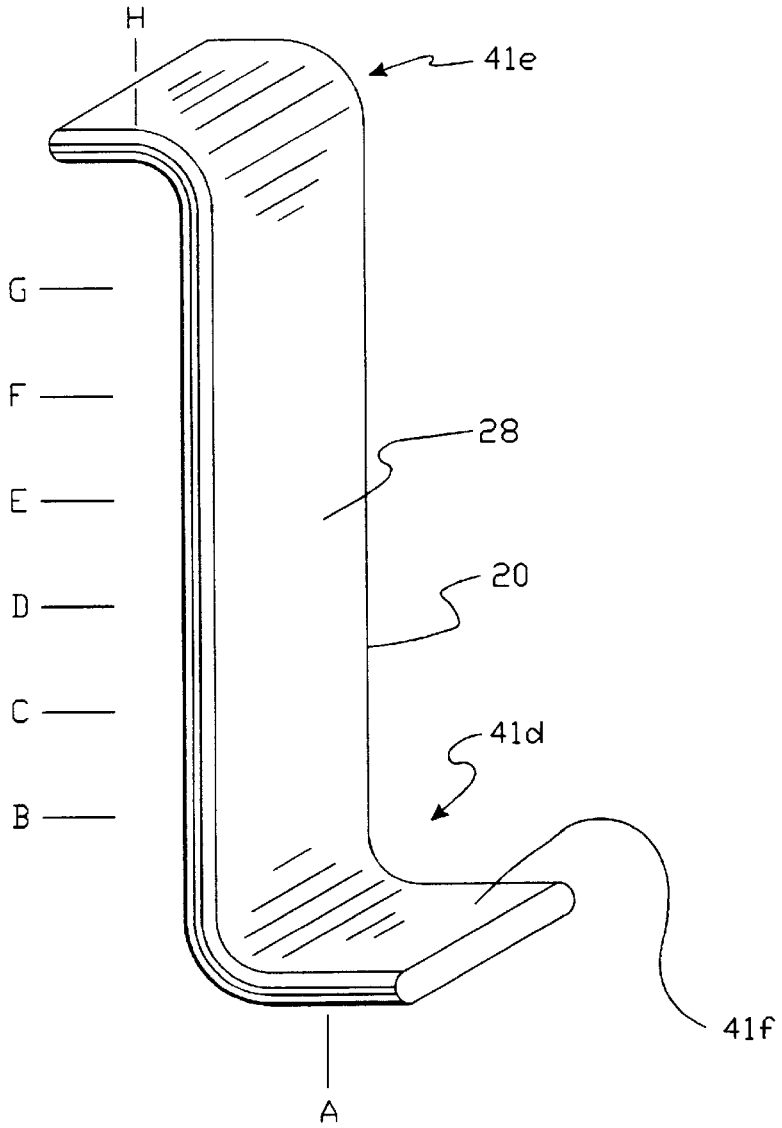
FIG. 3 is a perspective view of the obloid transport duct constructed in accordance with the preferred embodiment shown in FIG. 1, together with the indication of stations along the obloid transport duct where thermal couples were positioned to provide the readings presented in graphical form in FIGS. 7, 8 and 9.

Similar arrangements were made for the prior art duct 34' of FIG. 4*b*, as well as for the preferred embodiment of the present invention shown in FIG. 3. However, the cross-sectional locations of the thermocouple groups for the duct of FIG. 4*a* differ from those of duct 34, but are correlated in the presentations of data presented in FIGS. 5–9. The placement of thermocouples in the preferred embodiment of the present invention also differed somewhat as will be explained below in connection with discussion of FIG. 3.

Referring back to FIG. 4*a*, at each cross-sectional location A–K, each group of thermocouples would be used to deduce how evenly tobacco might be distributed across a plane defined at each location during operation of the particular tower. Because the gas introduced into the tower is at an extreme temperature in comparison to the relatively cool tobacco, a well mixed tobacco/gas system at a particular cross-sectional location would render approximately equal readings amongst the thermocouples 36–39 at that location. If one or more thermocouples differed in temperature readings from the others, then poor mixing and roping could be deduced at or about the respective cross-sectional location.

Referring again specifically to FIG. 4*a*, tobacco is fed through the inlet 35 into the 8 inch cylindrical transport duct 34 at a tobacco throughput rate ranging from about 180 to 700 pounds per hour, a gas stream velocity of approximately 85 feet per second, and a gas stream temperature of about 625° F. to 725° F. After flowing through the lower bend 41*a* and tending generally toward the backside 41*c* of the cylindrical duct 34, the tobacco particles 40 usually collected along the backside 41*c* at or about the location B to form what is referred to as a "dense phase flow" 42 or "roping" condition thereat, which tended to continue along the backside 41*c* until about location G. Just beyond location G the tobacco particles 40 tended to disperse throughout the gas flow within the duct 34 to form what is referred to as a "dispersed phase flow" 44, which remains established substantially throughout the remainder of the duct 34 leading to the upper bend 41*b*.

Figure 5:
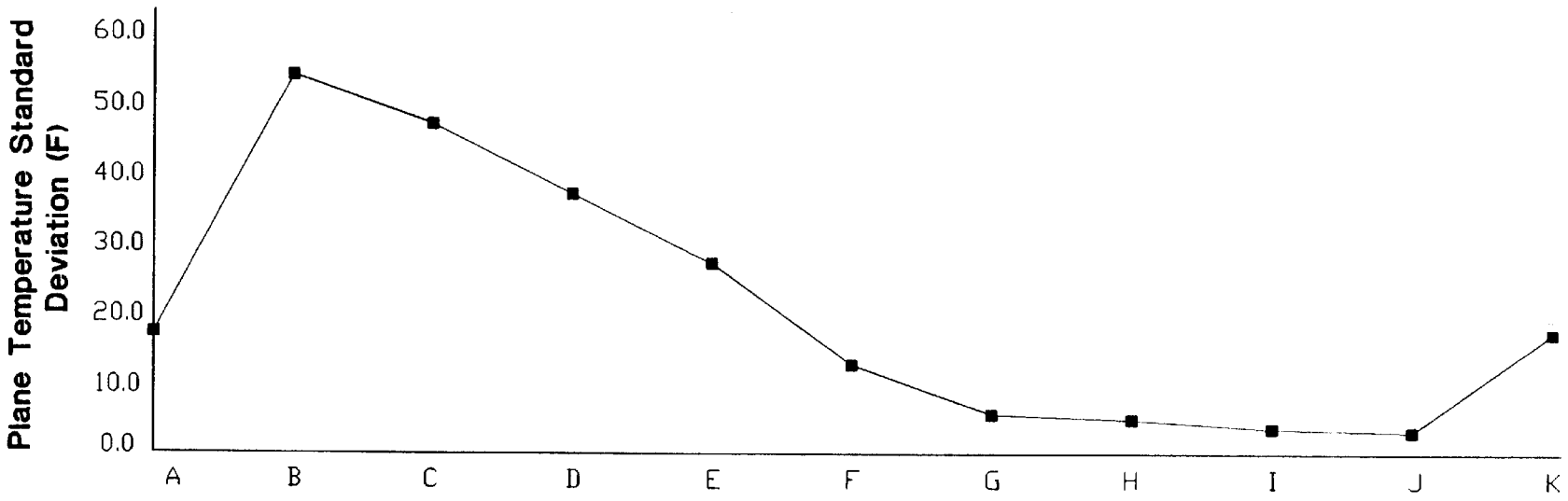
Fig. 5 (Prior Art)
FIG. 5 is a graphical representation of variations in thermal couple readings at each of various locations along the transport duct shown in FIG. 4*a;*

The initiation of the dispersed flow phase 44 at or about the location G as shown in FIG. 4*a* is evidenced by the graphical presentation in FIG. 5. The thermocouple readings at locations B–F rendered substantial values for standard deviation, indicating a roped condition therealong. The readings at locations G–J approached levels indicating a dispersed gas flow phase.

As previously discussed, the tobacco within the dense flow phase 42 mixes only with an adjacent portion of the hot gas stream, inhibiting the rate of heat transfer to the tobacco. The presence of a dense flow phase 42 in the lower portions of the cylindrical duct 34 is inimical to a rapid, uniform heating of the tobacco as it enters the tower.

Figure 6:
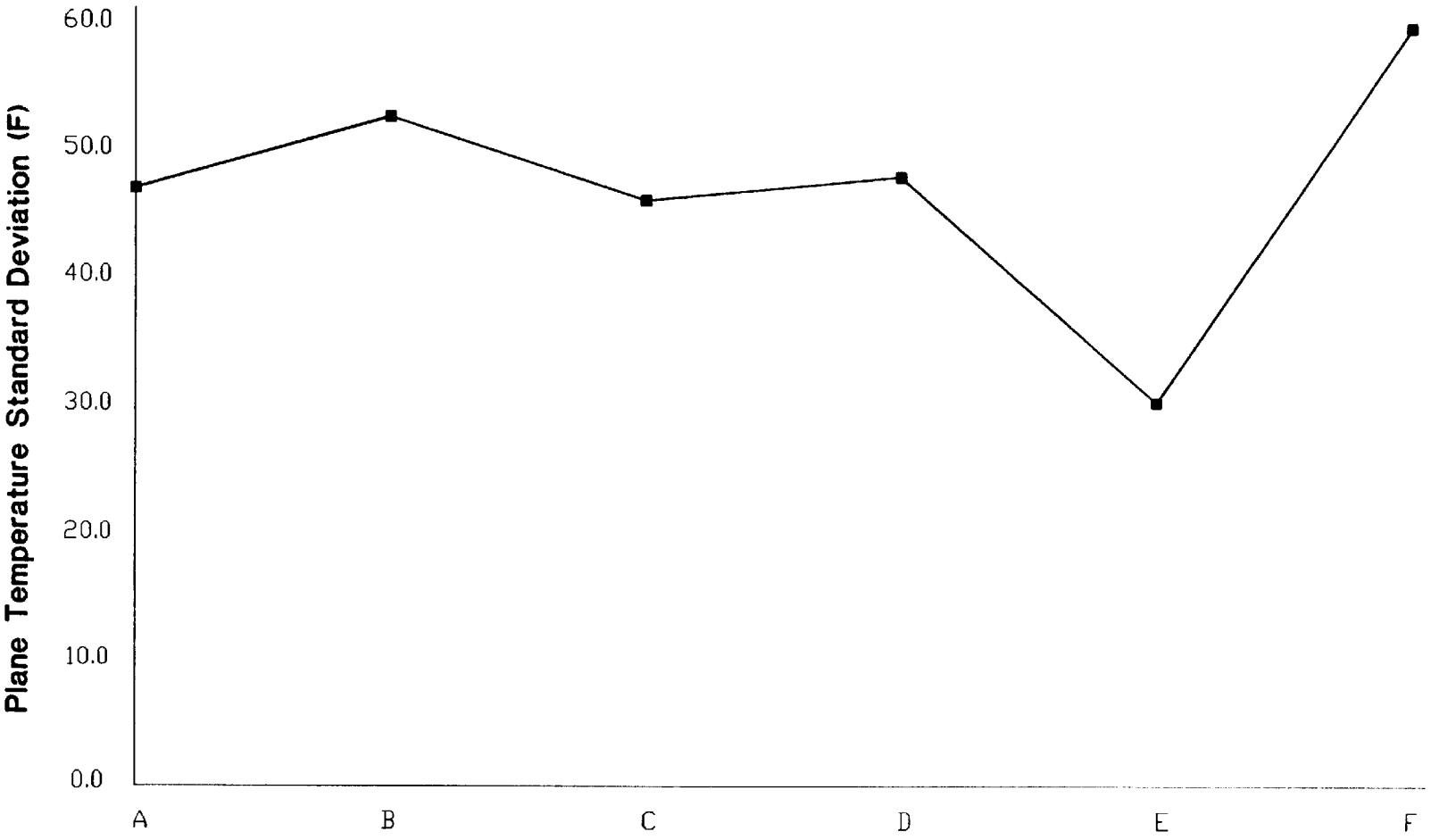
Fig. 6 (Prior Art)
FIG. 6 is a graphical representation of variations in thermal couple readings at each of various locations along the tower shown in FIG. 4*b;*

Referring now also to FIG. 4*b* and FIG. 6, in a production-sized, conventional cylindrical duct 34' of 24 inches pipe diameter, the dense phase flow along the wall of the duct 34' can extend, in certain circumstances, along the entire length of the duct 34', unless corrective measures are undertaken. The roping 42 along the entire length of the duct 34' is evidenced by the thermocouple readings graphically represented at the positions along duct 34' in FIG. 6. While not wishing to be bound by theory, the increased persistence of roping in larger diameter towers may be related in principle to the recognized relationship in fluid mechanics wherein the pipe length required to establish a given flow regime is proportional to the diameter of pipe under consideration. Traditionally, attempts to control this extensive roping in large, conventional cylindrical expansion towers have resorted to increasing the input velocities of the tower gas. Tower operators would prefer to operate production-sized expansion towers at gas velocities of approximately 85 feet per second, but in order to combat the roping effect, they have had to elevate gas velocities to 150 feet per second or more. These higher velocities are physically abusive to the tobacco and exacerbate breakage of the tobacco strands. Even at the elevated gas velocities, production scale ducts 34' still suffer substantial roping 42' even in the upper portions of the transport duct 34'.

Referring to FIG. 1 of the drawings, a preferred embodiment of the present invention provides a tower unit 10, which includes an inlet pipe section 12 for receiving a stream of hot gases, a venturi 16 downstream of the inlet 12 which cooperates with a rotary, inlet valve 18 and an obloid transport duct 20 downstream of the venturi 16. Preferably, the width of the venturi 16 is kept the same as that of the obloid duct 20. The rotary valve 18 evenly introduces a supply of tobacco at the venturi 16 uniformly across the tower width as the gas stream passes through the venturi 16 into the obloid transport duct 20. The rotary valve 18 is itself preferably fed tobacco from a vibratory conveyor 19 to provide consistent feeding of tobacco uniformly across the venturi 16. The discharge outlet of the feeder is rectangular, with the longer sides of the rectangle extending across a substantial portion of the width of the venturi 16. The obloid transport duct 20 discharges the stream of gas and entrained tobacco into a separator unit 22 from which gas is exhausted through a duct 24. Tobacco in an expanded condition is discharged through an outlet valve 26 of the separator unit 22. Preferably, the obloid transport duct 20 comprises a straight portion 28 disposed vertically, which may extend 20 to 25 feet or more in height.

At the inlet 12, tower gases are introduced at a temperature of 500° to 750° F., preferably to 650° to 700° F. and comprise 75% to 85% quality steam with minor air and carbon dioxide content, with the remainder of the gas comprising nitrogen, approximately 10% to 15%. However, it will be readily apparent to those of ordinary skill in the art upon a reading of this disclosure that the present invention is operable with various types and variations of tower gases and at various gas temperatures.

Figure 2:
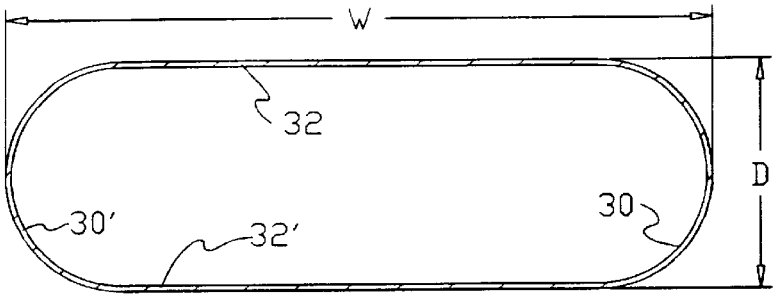
FIG. 2 is a cross-sectional view taken at line II—II in FIG. 1.

Referring now to FIGS. 1 and 2, preferably the obloid transport duct 20 is constructed to have an obloid shape (as previously defined) throughout its entire length, but at least throughout a substantial portion of its vertical section 28. The cross-sectional shape of the obloid transport duct 20 at any location therealong is preferably in the form of an oval configuration, and most preferably comprising, in cross-section, a pair of opposing semicircular endpieces 30 and 30', which are interposed by spacer plates or planer portions 32 and 32'. The planar portions 32 and 32' are preferably arranged parallel to one-another and separated by a distance D, which is to signify the "depth" of the duct. The width of the duct is to be characterized by the distance W in FIG. 2 measured from the lateral extreme of one circular end piece 30 to that of the other.

Referring to FIGS. 2 and 3, thermocouples were placed at each of the spaced locations A–H along the obloid transport duct 20 in a manner that provides readings that can be interpreted the same way as those for the cylindrical transport ducts 34 and 34'. Referring particularly to FIG. 2, at each of the locations A–H of the preferred embodiment, a thermocouple was placed on one of the end portions 30, 30' and at least two thermocouples were placed on each of the planar portions 32 and 32'. Referring particularly to FIG. 3, in the preferred embodiment, the location A was upstream of the lower bend 41*d* of the obloid transport duct 20 and the location H was downstream of the upper bend 41*e* of the obloid transport duct 20.

Figure 7:
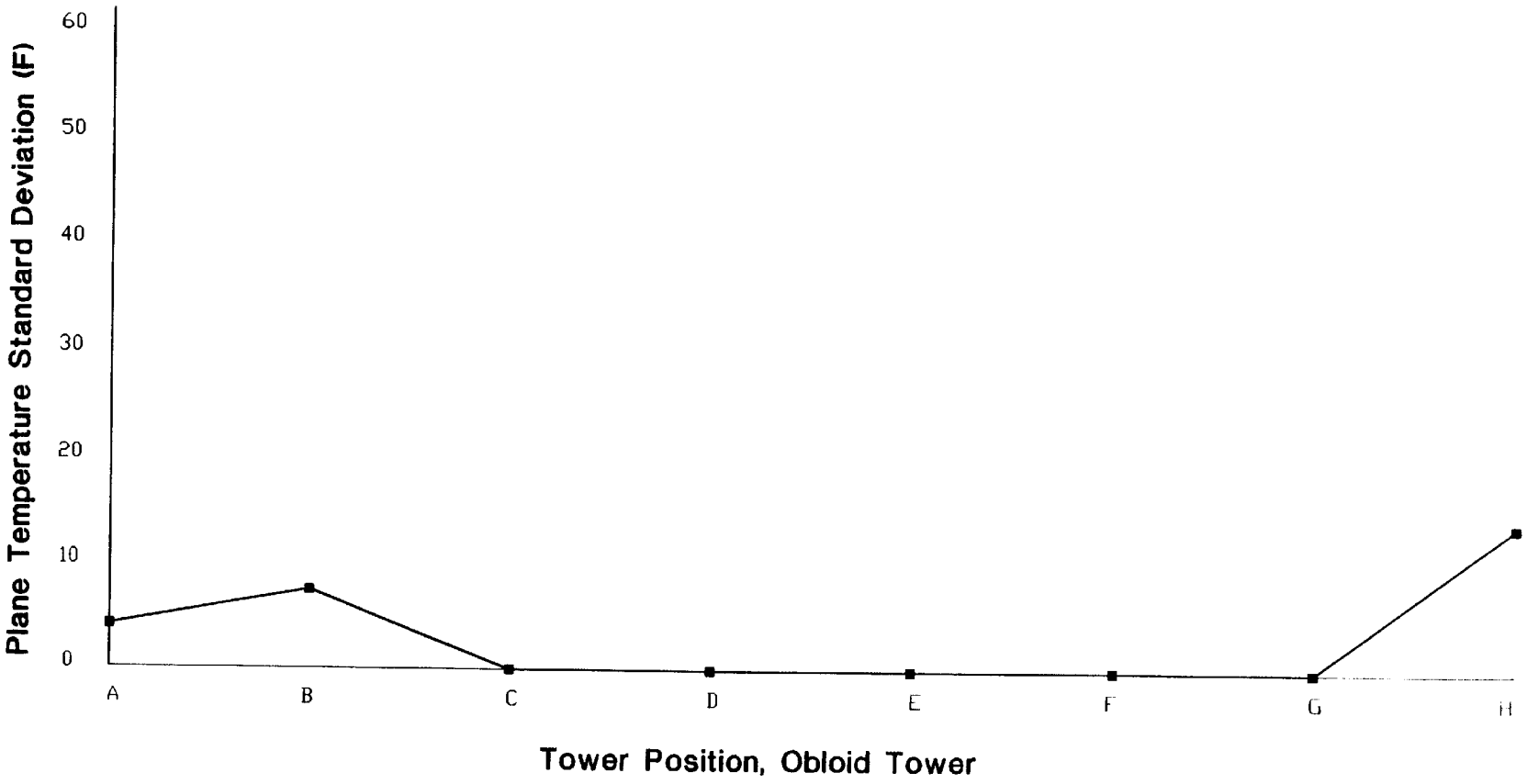
FIG. 7 is a graphical representation of variations in thermal couple readings at each of various locations along the obloid transport duct of the preferred embodiment in FIG. 3.

Referring now to FIGS. 2, 3 and 7, an obloid transport duct 20 was constructed in accordance with the preferred embodiment of the present invention and configured to handle the same range of tobacco throughput as the 8 inch cylindrical pilot duct 34 of FIG. 4*a*. Experimental information indicates that the obloid transport duct 20 initiates a fairly well dispersed flow phase as early as location A of the obloid duct in FIG. 3 prior to the lower bend 41*d*. After the lower bend 41*d*, a dispersed flow phase was reestablished, and the tobacco remained in a dispersed phase 44 throughout the substantial length of the obloid duct 20, as evidenced by the thermocouple readings graphically set forth in FIG. 7 for the obloid duct 20. The data indicated that even at the lower, vertical portions of the obloid duct 20 and even at the lower, horizontal portion 41*f* of obloid duct 20, the tobacco particles had mixed with the gas flow of the tower so as to achieve early and rapid heating of the tobacco. The rapid heating assures a more complete and efficient expansion of the tobacco.

Figure 8:
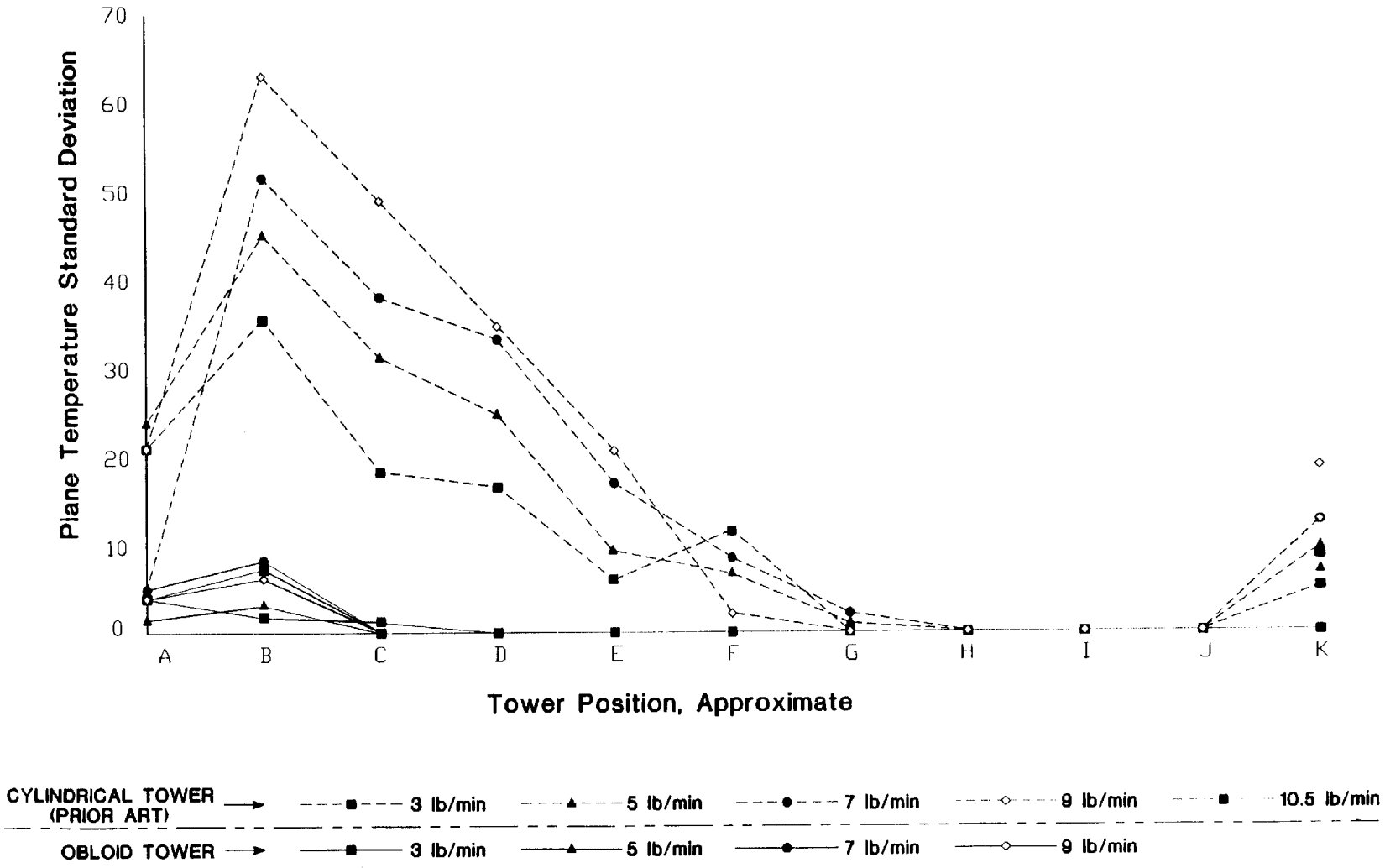
FIG. 8 is a graphical representation of variations in thermal couple readings at each of various locations along the transport duct of the prior art tower of FIG. 4*a* and those of the obloid transport duct of the present invention of FIG. 3, for different values of mass flow rate of tobacco.

The ability of the present invention to establish an earlier and more consistent dispersed flow phase is further evidenced in FIG. 8 wherein thermocouple readings in an 8 inch diameter cylindrical duct 34 are provided in comparison to those of an obloid transport duct 20 over a range of tobacco throughput rates from 3 to 10.5 pounds per minute. At all of these throughput rates, the present invention consistently achieved a dispersed flow phase at or about location C thereof, whereas the 8 inch cylindrical duct 34 of FIG. 4*a* suffered roping well beyond its location C. The information depicted in FIG. 8 also reveals that the obloid transport duct 20 of the present invention provides early initiation of a dispersed flow phase over a broad range of tobacco mass flow rates, whereas the cylindrical transport duct 34 registered readings indicating that as tobacco throughput was increased, roping became more pronounced. To its significant advantage, the obloid transport duct 20 is effective over a broader range of throughput.

Figure 9:
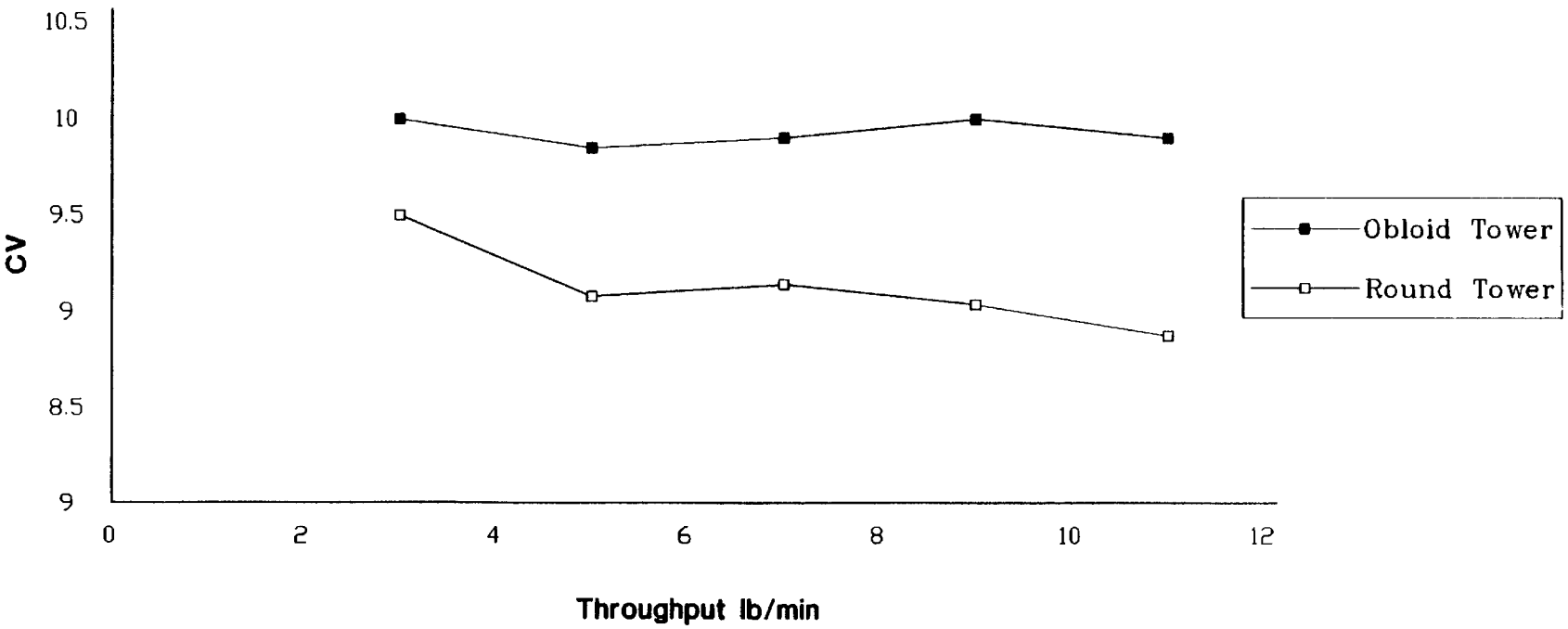
FIG. 9 is a graphical representation of cylinder volume of tobacco from the prior art tower of FIG. 4*a* in comparison to that of the present invention of FIG. 3, as a function of tobacco throughput.

In FIG. 9, the CV value of tobacco treated in an obloid tower 20 constructed in accordance with the preferred embodiment shown in FIGS. 1 and 2 is compared to the CV of tobacco processed through a pilot plant scale, cylindrical tower 34 of an 8 inch pipe diameter which was constructed in accordance with the prior art in FIG. 4*a*. The information set forth in FIG. 9 shows that as throughput of tobacco in pounds per minute is increased in a conventional cylindrical tower, the CV values of the discharged tobacco decreases significantly. In contrast, the obloid duct 20 of the preferred embodiment achieves a higher CV value at all values of throughput and the CV value remains fairly constant throughout the range of throughput. Not desiring to be bound by theory, it is believed that this advantage in CV consistency over a broad range of throughput is due to the ability of obloid transfer duct 20 to produce consistent initiation of dispersed phase flow at or about the lower location A of the obloid duct 20, just before the lower bend 41*d* and regain dispersed phase flow by location C, just after the lower bend 41*d*.

It is to be understood that these benefits of the present invention can be achieved with the imposition of even relatively narrow plates between semi-circular halves of a cylindrical duct. Accordingly, improved CV and earlier initiation of dispersed flow phase can be achieved even with production size ducts of 24 inches diameter or more by the expedient of changing their design to include flat plates between semi-circular portions as taught herein. These flat plates could be as short as 3 inches in length up to 50 inches or more; however, plates beyond 50 inches create practical problems with respect to how tobacco is fed at the tower inlet.

However, we now disclose a preferred method of determining a depth D and a width W in retrofitting an existing cylindrical tower or designing a new tower unit, so as to practice and enjoy the benefits of the present invention.

If one assumes that a selected conventional, cylindrical tower operates or is contemplated to operate at an inlet gas velocity $V_i$ and a desired, design tobacco throughput rate ($M_i$), the first step of our method preferably includes operating the selected tower at successively lower rates of tobacco throughput until an acceptable CV is obtained in the tobacco processed therethrough. In most conventional towers, CV will improve as throughput is decreased. The throughput rate at which an acceptable CV is obtained will be referred to as $M_{cv}$. In making these runs, the tower is preferably operated, experimentally and/or analytically, at moderate gas velocities of 60 to 100 feet per second, or more preferably at about 70 to 90 feet per second, which velocities are preferred because they minimize breakage of tobacco strands, while maintaining adequate transport characteristics. Additionally, the temperature of the tower gas ($t_1$) is adjusted so that the tobacco is discharged at essentially the same target exit OV or moisture level for all these experimental runs.

Once the reduced throughput rate $M_{cv}$ is resolved, its value, together with the tower length $L_T$, the residence time of the tobacco passing through length of the tower $L_T$ at the throughput $M_{cv}$, and the approximated or experimentally determined density of the tobacco in a roped condition are used to calculate the total volume that the tobacco would occupy if it were roped along the length $L_T$ of the tower. This volume is hereafter referred to as $\text{Volume}_1$. In undertaking this step, it is mathematically expedient and preferable to measure $L_T$ as the distance between the lower bend 41*d* and the upper bend 41*e*, exclusively.

Figure 10:
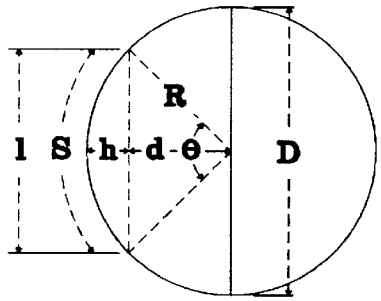
FIG. 10 shows a geometrical relationship and formula useful in practicing a preferred method that is an aspect of the present invention.

From the value of Volume, a calculation is undertaken to resolve a height h of a circle segment along the length of the tower LT which provides a volume equal to $\text{Volume}_1$. Because the diameter and length of the selected tower are known, calculation of the height h of such a circle segment is discernable by iterative calculations using the geometric relationships set forth in FIG. 10, wherein the ratio of $\text{Volume}_1$ to the total volume of the tower along the length $L_T$, a known value, equals the ratio of the cross-sectional area of the rope volume to the cross-sectional area of the pipe. (see also, *Handbook of Mathematical Tables and Formulas*, R. S. Burington, PhD, McGraw-Hill Book Company, 4th Ed., p. 16). The value for the height h is thus resolved.

The next step is to undertake another calculation to resolve the value for a desired width W of the obloid transport duct 20. Fundamentally, the calculation resolves for what value of width W in a rectangular duct having a height equal to the value of height h, provides a $\text{Volume}_2$, where $\text{Volume}_2$ equals $\text{Volume}_1$ multiplied by the ratio of the desired design tobacco throughput Mi to the other throughput rate $M_{cv}$. This step resolves a value for the width W of the obloid transfer duct 20 in accordance with the following equations:

$$(W)(h)(L_T)=\text{Volume}_1(M_i/M_{cv});$$

and $$W=\text{Volume}_1(M_i/M_{cv})/(h)(L_T).$$

In effect, the above step widens the duct from a circular cross-section to an obloid cross section by a factor of $M_i/M_{cv}$. This relationship establishes a minimum valve for W.

It is to be appreciated that the above step of resolving W could be performed by resolution of what hypothetical obloid duct (instead of a rectangular hypothetical duct), having a height equal to the value of h, provides a $\text{Volume}_2$, where $\text{Volume}_2$ equals $\text{Volume}_1$ multiplied by the factor of $M_i/M_{cv}$. However, the resolution of the width W with reference to a rectangular duct is a mathematical expedient that does not seem to significantly change the ultimate result.

The last step is to resolve the depth D of the obloid transport duct 20, preferably by setting D such that D, together with the already determined W, provide a total area approximating that of the total area of the original cylindrical duct, or some desired percent reduction or increase in total area. Before fixing the design of the obloid duct to that value of D, it is preferable for the designer to be resolved that the contemplated value for the depth D provides sufficient capacity to admit a gas flow large enough to achieve the desired exit OV or moisture level in the tobacco for a selected tower gas temperature. It is to be realized, however, that the present invention will enable one to operate at lower gas-to-tobacco mass flow ratios without adversely affecting tobacco exit CV because of the improved, more efficient mixing and heating of the tobacco with the tower gas.

Also, experience has indicated that if a calculated value for the depth D is approximately equal to a standard material size, one may set the value for depth D accordingly so that manufacture of the end portions 30 and 30' may be facilitated by the use of readily obtainable materials.

Summarizing, for a selected cylindrical tower having a design tobacco throughput, the above method first resolves a throughput rate that yields an acceptable CV. Once that is resolved, it is assumed conservatively that roping still exists along the entire length of the tower, and a height of a circle segment approximating the cross-sectional shape of such roping is calculated. The method then resolves how wide that roped tobacco would be on a planar surface, at no more than that same height, but for the original, greater tobacco throughput rate. That width is then used to resolve the width W of the obloid transport duct 20. The depth D is then resolved by approximating the area of the original cylindrical duct, with adjustment for assuring admission of sufficient tower gas flow. The technique, in effect, resolves a width which is sufficient for the tobacco to spread out laterally as it progresses through the tower to such an extent that tobacco roping is thinned-out and/or disrupted and the tobacco CV is improved.

Another manner of resolving the size and proportions of the cross-sectional shape of an obloid transport duct 20 in accordance with the preferred embodiment is to resolve analytically or experimentally initial values for the depth $D_i$ and width $W_i$ of an obloid tower 20, and thereupon experimentally resolving CV values for tobacco processed over a range of tobacco throughputs at the same tower gas temperature and gas velocity, preferably at or about 70 to 90 feet per second. If the experimental data indicates that the CV values are too low at a tobacco throughput rate $R_1$ less than the desired specified throughput rate $R_s$, then the width W of the obloid duct is increased, approximately in proportional relationship to the ratio of the rates $R_s$ to $R_1$. The experiment is then repeated with the new values for the depth D and the width W to resolve that the advantages of the present invention in CV value is obtained.

Another, approximating method of resolving the dimensions of an obloid tower 20 in accordance with the present invention is to set a ratio of the obloid tower width W to the obloid tower depth D at a value in the range of approximately 3 to 8, more preferably at a value between about 4.5 to 6.5, while satisfying the requirements for maintaining adequate cross-sectional area for tower gas flow. This technique is particularly suited for designing towers wherein the cross-sectional area is from about 50 to 300 square inches. As previously noted, benefits are obtained even with the inclusion of planar portions 32, 32' that are narrower than is provided by the above method, and one may prefer to construct an obloid transport duct well outside the range of 3 to 8.

Production scale cylindrical towers tend toward diameters approaching or about 24 inches in diameter to handle flow rates ranging from 3500 to 5500 pounds per hour. The preferred embodiment of the present invention can be scaled from a pilot plant size as described above to handle similar flow rates of a 24 inch diameter conventional tower by further increasing the width of the planar portion 32 and 32' and increasing the radius of the semi-circular portions 30 and 30'. Preferably the depth D, defined by the present invention, would be kept within a range of 4 to 20 inches, or more preferably between 6 and 14 inches. In retrofitting cylindrical towers, any of the above design methods could be used to arrive at appropriate values for widths W and depths D of an obloid transport duct 20 in accordance with the present invention, but more preferably, one would avoid equipment modifications by applying the first method above.

The above-described preferred embodiments relate to processes and apparatus for the expansion of tobacco that has been impregnated with an expansion-inducing agent such as carbon dioxide, freon or other agent. The present invention is readily adaptable to other tobacco processing operations, such as flash drying of moisture-laden tobacco to a predetermined final moisture level, such as described U.S. Pat. No. 3,357,436 to Wright and EPO 528 227 A1 of Körber AG. In Wright, tobacco is dried by introducing tobacco at a location along a path of heated air which carries the tobacco through a cylindrical, vertically oriented duct to effect an exchange of moisture between the tobacco and the stream of heated air. The Körber system entrains tobacco into a stream of heated air and/or heated steam or superheated steam, which is then directed through a cylindrical duct. These drying systems, like expansion towers, are prone to roping effects within their ducts, which problems may be alleviated with application of the present invention, that is, to pass the entrained tobacco and heated gaseous medium through an obloid duct constructed in accordance with and operated in view of the above teachings.

The above-described embodiments are to be regarded as illustrative rather than restrictive, and it should be appreciated that variations, changes and equivalents may be made by others without departing from the scope of the present invention as defined by the following claims. Practices in accordance with the present invention provide significant economic advantages in the operation of tobacco expansion plants. In particular, the present invention provides higher CV's at higher tobacco throughput rates with less tobacco breakage, resulting in higher filling power and higher tobacco yield.

What is claimed is:

1. Apparatus for drying tobacco with gaseous medium comprising a transport duct to which the tobacco and the medium are fed, wherein the transport duct is of obloid cross-section.

2. Apparatus according to claim 1 wherein the obloid transfer duct is substantially oval in cross-section.

3. Apparatus according to claim 1 wherein the obloid transfer duct has a cross-section defined by spaced apart parallel planar portions connected by opposing semi-circular end portions.

4. Apparatus for drying tobacco with gaseous medium comprising:

a first duct in communication with a source of heated gaseous medium;

a feeder for introducing tobacco into the first duct;

an obloid transport duct downstream of the feeder and arranged to receive the output of the feeder and the first duct; and a separator downstream of the transport duct.

5. Apparatus according to claim 4 wherein the obloid transfer duct is substantially oval in cross-section.

6. Apparatus according to claim 4 wherein the obloid transfer duct has a cross-section defined by spaced apart parallel planar portions connected by opposing semi-circular end portions.

7. Apparatus according to claim 4 wherein the obloid transfer duct has a first bend at a location adjacent to the feeder, a second bend at a location adjacent to the separator and a straight, vertical section between the first and second bends.

8. Apparatus according to claim 4, wherein the first duct includes a venturi and the feeder is adapted to introduce tobacco across the venturi.

9. Apparatus according to claim 8 wherein the venturi and the obloid transport duct are of substantially the same width.

10. Apparatus according to claim 8 further comprising a vibrating conveyor arranged to deliver tobacco to the feeder.

11. Apparatus according to claim 4, wherein the transport duct has a width to depth ratio in the range of approximately 3 to 8.

12. Apparatus according to claim 11 wherein the transport duct has a width to depth ratio in the range of approximately 4.5 to 6.5

13. A method of drying tobacco, comprising:

establishing a flow of heated gaseous medium;

feeding tobacco into the flow of heated gaseous medium;

dispersing the fed tobacco in the flow of heated gaseous medium by directing the flow of heated gaseous medium and the fed tobacco through an obloid transport duct; and separating the tobacco from the gaseous medium downstream of the obloid transfer duct.

14. A method of drying tobacco, comprising:

establishing a flow of heated gaseous medium;

feeding tobacco into the flow of heated gaseous medium;

directing the flow of heated gaseous medium and the fed tobacco through an obliod transport duct, the obloid transport duct having an obloid cross-sectional shape, width, and an inlet;

the feeding step including the step of dispensing the tobacco at a location adjacent the inlet and uniformly across the width of the obloid transport duct; and separating the tobacco and the gaseous medium downstream of the obloid transfer duct.

* * * * *